United States Patent [19]

Gavin et al.

[11] Patent Number: 5,066,169

[45] Date of Patent: Nov. 19, 1991

[54] RETAINING WALL SYSTEM

[76] Inventors: Norman W. Gavin, 2545 Ridge Rd., North Haven, Conn. 06473; Felix P. Jaecklin, 46 Geissbergstr, CH 5400 Ennetbaden, Switzerland

[21] Appl. No.: 656,914

[22] Filed: Feb. 19, 1991

[51] Int. Cl.[5] ..... E02D 29/02

[52] U.S. Cl. ..... 405/284; 405/262; 405/286

[58] Field of Search ..... 405/258, 262, 272, 284, 405/285, 286

[56] References Cited

U.S. PATENT DOCUMENTS

| | | | |
|---|---|---|---|
| 770,844 | 9/1904 | Church . | |
| 1,349,166 | 8/1920 | Paff | 405/286 |
| 1,663,453 | 3/1928 | Coke-Hill | 405/286 |
| 4,521,138 | 6/1985 | Steiner | 405/284 |
| 4,661,023 | 4/1987 | Hilfiker | 405/262 |
| 4,668,129 | 5/1987 | Babcock et al. | 405/284 |
| 4,671,706 | 6/1987 | Giardini | 405/286 |
| 4,684,294 | 8/1987 | O'Neill | 405/286 |
| 4,804,299 | 2/1989 | Forte et al. | 405/285 |
| 4,884,921 | 12/1989 | Smith | 405/286 |

*Primary Examiner*—David H. Corbin

*Attorney, Agent, or Firm*—Robert A. Seeman

[57] ABSTRACT

A retaining wall module with a front wall which includes a rearwardly depending horizontal base wall and two upstanding rearwardly depending side walls. The front wall extends beyond the attachment of the side walls. Another horizontal base wall is attached to the bottom of the extending portion of the front wall and to a side wall. Recesses are provided at the top and bottom of the side walls for receiving transversely, stabilizer bars which bridge between adjacent modules. Bar or ridge means on the bottom wall, generally parallel to the front wall, retain geogrid fabric when covered with weighty material.

15 Claims, 3 Drawing Sheets

RETAINING WALL SYSTEM

BACKGROUND OF THE INVENTION

1. Field of the Invention

The present invention relates to control of earth movement, more specifically to a retaining wall system which takes maximum advantage of earth loading and friction for long term structural stability, and low cost installation.

2. Description of the Prior Art

A typical retaining wall is usually constructed with a plurality of similar modules. Each module is designed to be held in place by anchoring to or within the earth behind the wall. The module stacks upon another module to build up wall height, and is installed adjacent to another to build wall width. The module is made of plain or reinforced concrete for the weight that it provides, and for the relatively low cost for the size and mass that it provides.

U.S. Pat. No. 770,844, patented Sept. 27, 1904 by W. L. Church, describes a retaining wall which includes a forward, upright wall joined along the length of its base by a horizontal bottom wall. A series of parallel, spaced, upright buttress walls, each of which is perpendicular to the upright and bottom walls are joined to the upright and bottom walls.

Tension rods molded into the buttress walls along the upper edge and rear edge margins of the buttress walls, meet at an apex opposite to the apex formed by the joining of the forward and bottom walls, and extend into and anchor in the upper margins of the forward walls and rearward margins of the bottom walls.

In installation, material of the retained embankment rests against the rearward surfaces of the forward, upright wall, the upward surface of the bottom wall, and exposed surfaces of the buttress walls.

The portion of each buttress which runs between the apex of the general meeting of the tension rods and the apex of the meeting of the meeting of the forward and bottom walls acts as a compression strut between these two opposed apices.

U.S. Pat. No. 4,668,129 patented by Babcock et al. on May 26, 1987, discloses a wall assembly of precast concrete modules comprised of independent elements.

The front of each module includes at each end, a vertical column portion that is attached to a vertically oriented, rearward depending triangular buttress wall. The bottom of the buttress is supported along its length by a narrow, flat, horizontally oriented base.

The front of the module comprises a vertical wall panel which rests, unattached, at each end respectively upon one of the two columns.

In assembling the wall, earth is piled behind the front of a first base tier module, over the buttresses and base and against the vertical wall panel, to a level that is slightly below the top of the vertical column portion. In the base tier module, the vertical wall panel rests at each end upon the horizontal base of the buttresses.

Further retainer wall height is attained by resting a second module that is configured for building height, on the new earth level that is slightly below the top of the vertical column portion. The wall of the second module is supported by the columns of the first module as described above. The wall of the second module is not attached to the buttresses or their bases, but is free to move as it rests upon the columns.

Each base of the second module stops short of the column that is attached to the buttress to which it is joined. A downward facing gap therefore is defined by edgewise surfaces of the column, the buttress and the base. When the second module is stacked over the first module, installed on the earth fill behind the first module, the gap allows the top of the column of the first module to extend up onto the gap without binding so that the vertically disposed tiers formed by the stacked modules can move independently.

The column portions have a battered configuration so that they form a "ship lap" type of configuration when the modules are stacked.

The ability of the stacked elements for slight relative movement between vertical tiers helps to reduce bearing stress on soil below the base portions by creating arching in the soil. This reduces necessary length of the base and buttress compared to the height of the tier that is established by the module.

U.S. Pat. No. 4,684,294, patented Aug. 4, 1987 by R. J. O'Neill, describes a precast concrete module having a rectangular upstanding front wall, and a rearward depending buttress or beam in the form of an upstanding wall joined to the center of the front wall in the form of a "T" as viewed from the top.

A side of the buttress wall includes lengthwise rectangular indentations which become filled with earth when the buttress is covered with earth to anchor the module in the embankment that it retains. The buttress wall includes a sloped rear end with a V shaped vertical groove for additional frictional engagement with the soil.

In the bottom tier, the front wall rests lengthwise upon a first horizontal rectangular concrete footer, and the buttress wall rests upon a second, transverse, rectangular, horizontal footer that is generally parallel to the first footer. A notch is provided in the bottom edge of the buttress wall to accommodate a portion of the vertical thickness of the second footer.

The top and bottom edges of the front wall include complementary lips for engaging when the modules are stacked one above another.

The buttress wall includes a notch on the top for receivng a transverse bar that is also received in the bottom notch of a buttress wall of the next tier up. The transverse bar, which extends a small distance to either side of the buttress wall, provides resistance to shear between stacked modules, and binds in the soil to resist by a fulcrum effect, rotation of the module.

When it is desired to locate the modules of an upper tier between those of the lower tier, wherein an upward T falls between two lower T's, the transverse bar extends across two modules to support the buttress of the middle T.

U.S. Pat. No. 4,804,299 patented Feb. 14, 1989 by Forte et al., describes a modular wall assembly which includes a series of horizontally spaced, vertical posts. Each post, presenting an H configuration in cross section, is embedded in the ground for about half of its length. The face of the wall is completed by panels between the posts, each panel extends at each end into a groove of the H configuration, and is embedded into the ground for about half of the depth of that attained by the posts.

Horizontal, open grids of polymeric material for further anchoring the wall to the soil are attached to the back of the panel at different heights on the panel by thermal bonding to reinforcement grid molded within the panel, or to hooks which are attached to reinforcement grid within the panel.

During installation, the earth to be retained behind the wall is graded to the level at which the lower of the grids will be laid. The grid is then covered with earth to the wall up to the level at which the next uppermost grid is to be laid. Grading, laying and covering continues until all grids to be laid are in place.

SUMMARY OF THE INVENTION

It is one object of the invention to provide a retaining wall which can be assembled from modular elements.

It is another object of the invention to provide a module for the wall which is anchored to the soil by friction and soil mass.

Another object is to provide a module which may be stacked in tiers to build wall height.

Another object is to provide a stackable module which may be installed at the first tier on graded soil without the need for footers or leveling pads.

Another object is to provide a module which provides long time stability in a single tier or stacked configuration without the need for extending the buttress a long distance rearward of the wall.

Still another object is to provide a module which easily and securely retains geogrid textile anchoring.

Yet another object is to provide a module which allows face-down molding to provide accurate stacking surfaces.

Other objects and advantages will be readily apparent from the ensuing description.

In accordance with the invention, a retaining wall includes a first module with a first upstanding front wall, a second horizontal bottom wall attached to back of the front wall along a substantial length of the back. A pair of third and fourth spaced, upstanding walls are also attached to the back of the front wall and to the bottom wall.

The front wall extends toward each end, beyond the attachments of each of the two walls to the front wall.

A fifth horizontal wall is attached to the fourth wall and the bottom of the portion of the first wall which extends beyond the attachment of the forth wall to the first wall.

Recesses are provided at the top and bottom of the third wall for receiving, transversely, a stabilizer bar.

Bar or ridge means are provided on the top of the bottom wall, generally parallel to the front wall, for retaining geogrid fabric when covered with weighty material.

BRIEF DESCRIPTION OF THE DRAWINGS

In order that the invention be more fully comprehended, it will now be described, by way of example, with reference to the accompanying drawings, in which.

Figure 1:
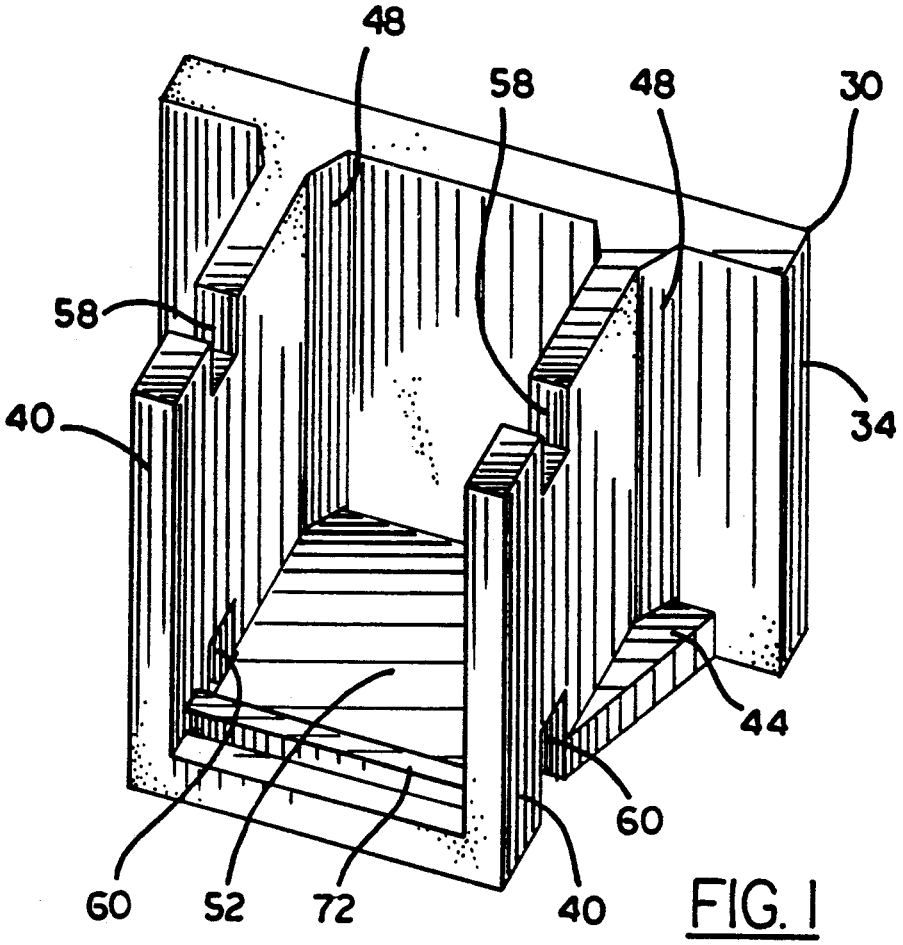
FIG. 1 is a rear perspective view of a module constructed according to the present invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIG. 1, retainer wall module 30 includes front wall 34 and a pair of buttress walls 40.

Buttress walls 40 are the same height as front wall 34. They are reinforced in their attachment to the front wall by wings 44 and thickened portions 48. Preferably, the tops of buttress walls 40 and the top of front wall 34 are in the same plane.

Horizontal base wall 52 is attached to buttress walls 40 and front wall 34.

Figure 4:
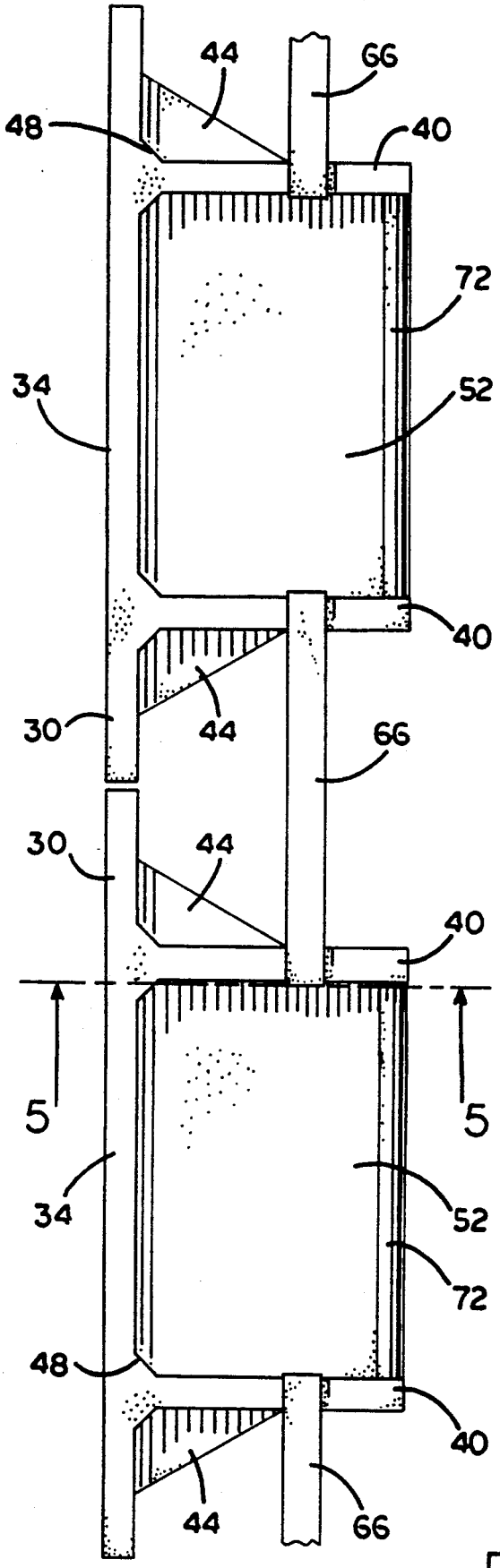
FIG. 4 is a top view of a pair of modules arranged adjacent to one another in a wall, of which they are the second tier, stacked over two similarly arranged modules.

Upper recesses 58 and lower recesses 60 are provided to receive stabilizer bars 66 which will be described later. Lower recess 60 primarily extends upward into the buttress wall, but may also extend slightly into base wall 52 as shown in FIGS. 1 and 4.

The bottom surfaces of base wall 52, front wall 34 and wings 44 are preferably in the same plane, to provide maximum stability for the module on soft or yieldable earth. The lower surface area of wing 44 helps to resist forward rotation of the module in response to earth loading against the back of front wall 34.

It should be clear that the term "earth" is used in the broadest sense. It includes such fill material, for example, as soil, rock, sand and gravel.

Figure 2:
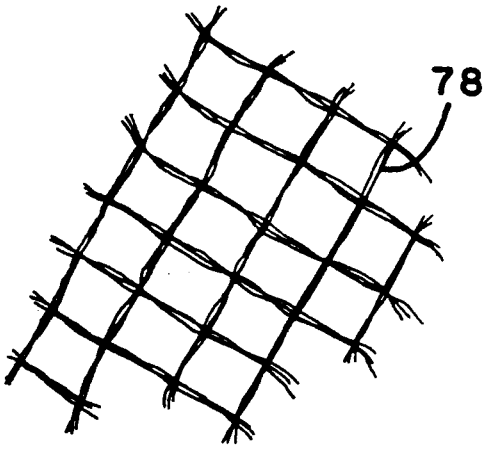
FIG. 2 is a schematic view of a geogrid cloth for contributing to the anchoring of a module, according to the present invention.
Figure 3:
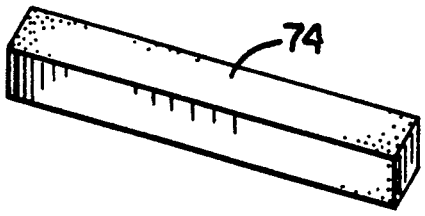
FIG. 3 is a perspective view of a locking bar for locking the geogrid in the module.

Lock bar 72, in conjunction with retainer bar 74 shown in FIG. 3, locks geogrid 78 shown in FIG. 2, within the module when a portion of the geogrid is laid over bar 72, and under bar 74 which is positioned parallel to and against bar 72 on wall 52. Preferably, the geogrid is wrapped around bar 74 before it is positioned in the module. Earth piled on the geogrid and bar assembly helps to tighten the lock.

Geogrid fabric is commercially available from several sources. One source, for example, is Mirafi brand Miragrid 5T, available from Mirafi Company, P.O. Box 240967, Charlotte, N.C. 28224, tel 800-438-1855. The geogrid fabric anchors in the earth by friction, and resists forces which cause rotation and displacement of the module.

Figure 6:
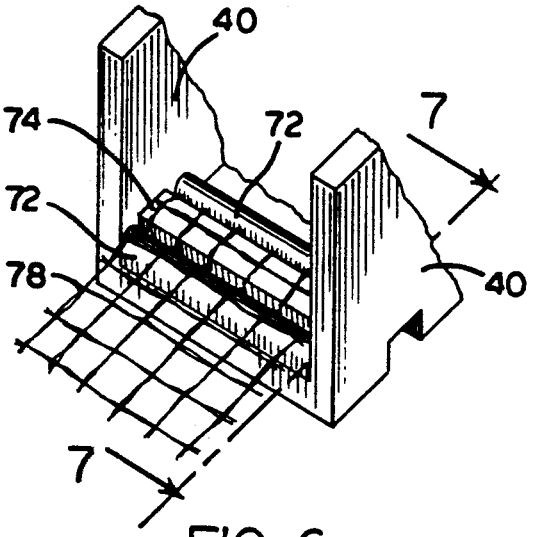
FIG. 6 is a rear perspective view of a portion of a module of another embodiment of the invention.
Figure 7:
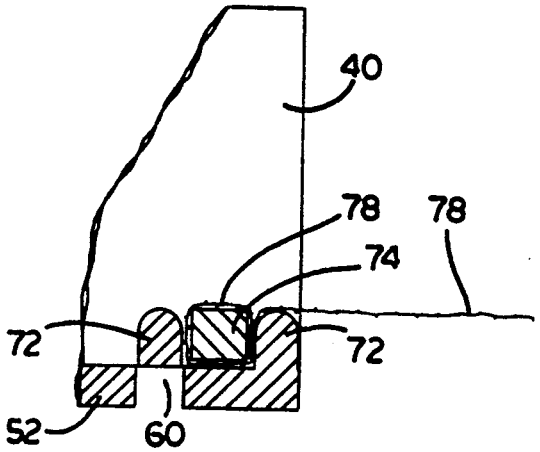
FIG. 7 is a cross section view of the module of FIG. 6, as viewed at 7—7.

As shown in FIGS. 6 and 7, greater retention of the geogrid is provided by a pair of lock bars 72 which define a channel for receiving retainer bar 74 with wrapped geogrid.

In FIG. 4, second tier modules 30 which are arranged adjacent to one another in part of a retaining wall, are stacked over another set of first tier modules that are not visible in this figure. Two of the stacked modules, however, are shown in cross section in FIG. 5.

Referring to FIG. 4, each module of the horizontal assembly of modules receives two stabilizer bars 66, one in each upper recess 58, which bridge between that module and its adjacent counterpart modules.

Figure 5:
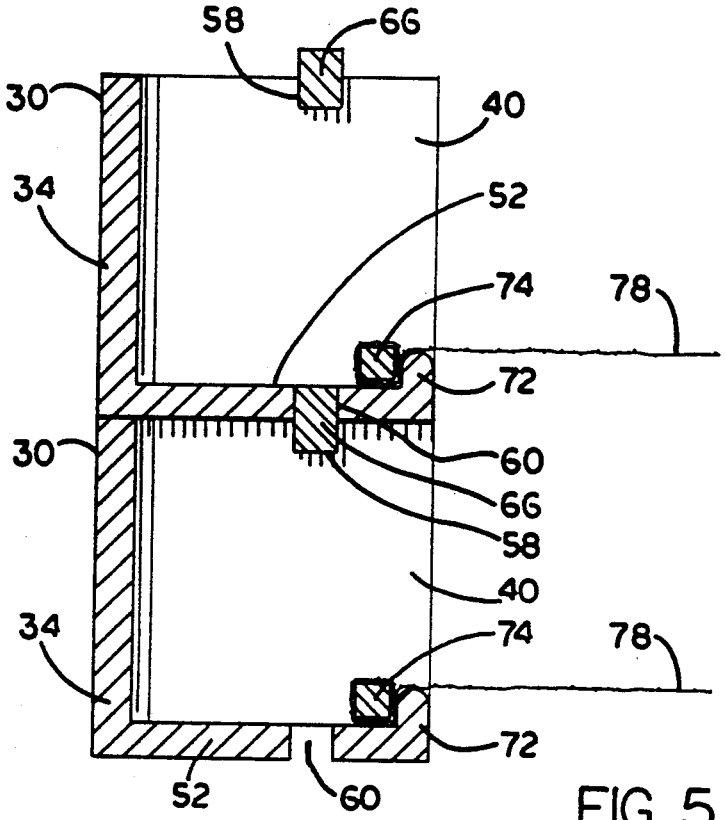
FIG. 5 is a cross section view of a pair of stacked modules in the arrangement of FIG. 4, as viewed at 5—5.

Referring to FIG. 5, stabilizer bar 66 also engages adjacent stacked modules to keep front walls 34 in the same plane and resist shear between the modules.

In constructing a retainer wall with the present invention, the site for the wall is graded flat and level. The first tier of modules is placed on the graded land with the modules side by side, preferably with their front walls in the same plane. In each module, the geogrid is wrapped on retainer bar 74 which is installed within the module as described earlier. The geogrid is arrayed rearward on the graded surface, and land is backfilled over the graded surface to the height of front wall 34, and graded level.

Preferably the graded surface over which the geogrid will be laid is brought up approximately to the level of lock bar 72 before the geogrid is arrayed rearward.

If desired, the earth is channeled back between upper recesses 58 to allow stabilizer bars 66 between the modules to fully seat in the upper recesses.

The second tier of modules is installed over the first tier, preferably with their front walls in the same plane as the walls below. The geogrid is installed within the second tier, and backfill and grading is undertaken as above.

The procedure continues until the retainer wall is built to the desired height.

Module 30 is preferably molded from concrete, although it may be made from reinforced plastic or metal. The mold for the module includes metal facing for molding the top and bottom surfaces of the module, so that those surfaces are flat, smooth and parallel to one another.

By the above description it is seen that the present invention provides a modular retaining wall system that is anchored to the soil by weight of the soil and by friction with the soil for long time stability.

The system includes a module which includes wings to resist rotation, geogrid fabric deployed to resist rotation and displacement of the module, and means for locking the geogrid fabric securely in the module.

Stabilizer bars further resist rotation and relative shifting of assembled modules.

The module is simply and easily installed without the need for footer or leveling pad.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. A retaining wall system comprising:

a first module, the front of said module comprising a first wall, said first wall being vertical and including a front, a back, a top, a bottom, a first end, and a second end, said first module further comprising:

a second wall, said second wall being horizontal and including a front, a back, a top and a bottom, and being attached to the bottom of said first wall along a substantial length of the back of the first wall, a third wall, said third wall being upstanding and being attached to the back of the first wall, to the top of the second wall, and depending back from the first wall, a fourth wall, said fourth wall being upstanding and being attached to the back of the first wall, to the top of the second wall, depending back from the first wall, and spaced from the third wall, said third and fourth walls being parallel with one another, and comprising parallel, horizontal transitions in their attachments with said second wall, the top of said first wall being generally coplanar with the tops of said third and fourth walls, and the bottoms of said first and second walls being generally coplanar.

2. A retaining wall system as described in claim 1, said first module further comprising:

said first and second ends of the first wall extending horizontally beyond the attachments of the third and fourth walls to the first wall, and ending straight, vertical, and square with the top of said first wall.

3. A retaining wall system as described in claim 2, said first module further comprising:

a fifth wall, said fifth wall being horizontal, generally coplanar with said second wall, and being attached to the fourth wall, and to the bottom of the portion of the first wall which extends beyond said attachment of the fourth wall to the first wall.

4. A retaining wall system as described in claim 1, said first module further comprising:

a stabilizer bar, said third wall defining a recess at the top of said third wall for receiving transversely said stabilizer bar beginning at said recess for minimum interference with the vertical space over said second wall, and extending perpendicularly away from said third wall.

5. A retaining wall system as described in claim 1, said first module further comprising:

a raised ridge on the top of said second wall, generally parallel to said first wall, for receiving a geogrid fabric over said ridge for locking said fabric in said module when said fabric and said ridge are covered with earth.

6. A retaining wall system as described in claim 5, said first module further comprising:

a retainer bar means on the top of said second wall, generally parallel to, and forward of said raised ridge, for receiving said geogrid fabric wrapped around said retainer bar for locking said fabric in said module when said fabric, wrapped around said retainer bar and passing over said ridge, is covered with earth over said retainer bar and said ridge.

7. A retaining wall system as described in claim 4, further comprising:

a second module comprising an upstanding front wall and a pair of spaced apart upstanding side walls attached to and depending back from said front wall, said sidewalls each defining a recess at their top for receiving transversely a stabilizer bar, said first and second modules being positioned close together with said first wall and said upstanding front wall being generally coplanar, and said stabilizer bar beginning at the recess at the top of said third wall, and ending at the recess in the sidewall that is closest to said third wall.

8. A retaining wall system comprising:

a first module, the front of said module comprising a first wall, said first wall being upstanding and including a front, a back, a top, a bottom, a first end, and a second end, said first module further comprising:

a second wall, said second wall being horizontal and including a front, a back, a top and a bottom, and being attached to the bottom of said first wall along a substantial length of the back of the first wall, a third wall, said third wall being upstanding and being attached to the back of the first wall, to the top of the second wall, and depending back from the first wall, a fourth wall, said fourth wall being upstanding and being attached to the back of the first wall, to the top of the second wall, depending back from the first wall, and spaced from the third wall, said third wall defining a recess at the top of said third wall for receiving transversely a stabilizer bar, and said third wall defining a recess at the bottom of said third wall for receiving transversely a stabilizer bar.

9. A retaining wall system comprising:

a first module, the front of said module comprising a first wall, said first wall being upstanding and including a front, a back, a top, a bottom, a first end, and a second end, said first module further comprising:

a second wall, said second wall being horizontal and including a front, a back, a top and a bottom, and being attached to the bottom of said first wall along a substantial length of the back of the first wall, a third wall, said third wall being upstanding and being attached to the back of the first wall, to the top of the second wall, and depending back from the first wall, a fourth wall, said fourth wall being upstanding and being attached to the back of the first wall, to the top of the second wall, depending back from the first wall, and spaced from the third wall, said first and second ends of the first wall extending beyond the attachments of the third and fourth walls to the first wall, said third wall defining a recess at the top of said third wall for receiving transversely a stabilizer bar, and said third wall further defining a recess at the bottom of said third wall for receiving transversely a stabilizer bar.

10. A retaining wall system as described in claim 9, said first module further comprising:

a first bar means on the top of said second wall, generally parallel to said first wall, for retaining a geogrid fabric when covered with weighty material.

11. A retaining wall system as described in claim 10, said first module further comprising:

a fifth horizontal wall attached to the fourth wall, and to the bottom of the portion of the first wall which extends beyond said attachment of the fourth wall to the first wall.

12. A method for erecting a modular wall for retaining earth between two heights behind the wall, said method comprising:

installing a module by:

grading the earth at the lowest height to a level state, resting a first module which includes a vertical front wall and a pair of parallel, spaced apart side walls attached to and depending back from the front wall, and which further includes a floor wall attached to the side walls and the front wall with the bottom of the floor wall generally coplanar with the bottom of the front wall, on the graded earth, positioned so that the front wall is at the location and direction of the desired retaining wall, resting geogrid fabric over a raised ridge on the floor wall in the space between the side walls, said raised ridge being parallel to the front wall, and extending the fabric on earth behind the module, filling earth in on the floor wall, including over the fabric and ridge, to the front and side walls of the module behind the front wall.

13. The method for erecting a modular wall for retaining earth between two heights behind the wall as described in claim 12, further comprising:

grading the filled in earth so that it is approximately even with the top of the first module, resting a second module that is like the first module, upon the first module, with the front wall of the second module directly over the front wall of the first module, and in the same plane as the front wall of the first module, and in the second module;

resting geogrid fabric over a raised ridge on the floor wall which is parallel to the front wall, and extending the fabric on earth behind the module, filling earth in on the floor wall to the front and side walls of the second module behind the front wall.

14. The method for erecting a modular wall for retaining earth between two heights behind the wall, as described in claim 12, further comprising:

before extending the fabric on earth behind the module, making the surface of the earth behind the module for receiving the fabric to be approximately at the level of the raised ridge that is on the floor wall between the side walls.

15. A method for erecting a modular wall for retaining earth between two heights behind the wall, said method comprising:

installing a module by:

grading the earth at the lowest height to a level state, resting a first module which includes an upstanding front wall and a pair of spaced apart side walls attached to and depending back from the front wall, and which further includes a floor wall attached to the side walls and the front wall, on the graded earth, positioned so that the front wall is at the location and direction of the desired retaining wall, resting geogrid fabric across a bar which is on the floor wall and which is parallel to the front wall, and extending the fabric on earth behind the module, filling earth in on the floor wall to the front and side walls of the module behind the front wall, and resting and installing a second module that is like the first module, next to the first module in the same manner as the installation of the first module, with the front wall of the second module in the same plane as the front wall of the first module, and as part of the installation, placing a stabilizer bar between the first and second modules, oriented generally parallel to the plane of the front wall, by inserting the stabilizer bar within a recess in the top of a side wall of each of the adjacent modules.

* * * * *